United States Patent [19]

Osborg

[11] 4,197,081

[45] Apr. 8, 1980

[54] METHOD FOR IMPROVING COMBUSTION OF FUELS

[76] Inventor: Hans Osborg, 80 Longview Rd., Port Washington, N.Y. 11050

[21] Appl. No.: 24,094

[22] Filed: Mar. 26, 1979

[51] Int. Cl.[2] ..... F23C 1/00

[52] U.S. Cl. ..... 431/2; 44/52; 44/53; 44/56; 44/57; 44/64; 44/67; 44/72; 44/76

[58] Field of Search ..... 44/53, 52, 56, 57, 64, 44/67, 72, 76; 431/2, 4

[56] References Cited

U.S. PATENT DOCUMENTS

| | | | |
|---|---|---|---|
| 1,501,383 | 7/1924 | White | 44/53 |
| 2,357,184 | 8/1944 | Frejacques | 44/52 |
| 2,559,605 | 7/1951 | Drouilly | 44/52 |
| 2,673,793 | 3/1954 | Brodhacker | 44/53 |
| 2,978,302 | 4/1961 | Siegel et al. | 44/64 |
| 2,978,502 | 4/1961 | David et al. | 44/72 |
| 3,065,064 | 11/1962 | Barusch | 44/53 |
| 3,082,598 | 3/1963 | Mahan | 44/72 |
| 3,108,431 | 10/1963 | Armstrong et al. | 423/648 X |
| 3,403,014 | 9/1968 | Von Allmen | 44/72 |
| 3,405,130 | 10/1968 | Hogsett et al. | 44/72 |
| 3,873,277 | 3/1975 | Coon | 44/64 |
| 3,883,376 | 5/1975 | Billig et al. | 44/76 |

*Primary Examiner*—Winston A. Douglas
*Assistant Examiner*—Y. Harris-Smith
*Attorney, Agent, or Firm*—Kane, Dalsimer, Kane, Sullivan and Kurucz

[57] ABSTRACT

Disclosure is made of a method of improving the combustion of base fuels selected from ammonia, petroleum distillates, alcohols and amines. The method comprises the addition of hydrogen carriers to the base fuels, which possess an energy content and release it together with hydrogen for combustion upon ignition of the base fuel. The disclosure is also of novel fuel compositions which comprise from 0.5 to 15 percent by weight of a hydrogen carrier dissolved or suspended in the base fuel.

4 Claims, No Drawings

METHOD FOR IMPROVING COMBUSTION OF FUELS

BACKGROUND OF THE INVENTION

1. Field of the Invention

The invention relates to novel fuel compositions and their use and more particularly concerns methods of improving the combustion of fuels such as ammonia, petroleum distillates, alcohols and amines by release of energy and hydrogen at the time of ignition.

2. Brief Description of the Prior Art

It is vital that new sources of high energy fuels be developed and that presently available substandard fuels be improved to raise their usefulness and efficiency. Prior hereto, it was appreciated that ammonia, petroleum distillates such as naphtha, benzene and the like, volatile alcohols and amines were fuels which upon combustion form combustion gases with considerably greater thermal energy than the initial combustion reactants. However, each of the above mentioned fuels has failed to achieve an important commercial position as an energy source. As fuels, ammonia, certain of the petroleum distillates, volatile alcohols and amines have shortcomings which can very generally be said to relate to an unsatisfactory combustion. The reasons for the unsatisfactory combustion are varied and individual to the particular fuel as will be described in greater detail hereinafter.

There is agreement among those who are knowledgeable in the field of energy fuels that hydrogen is the ideal fuel of the future, but that it will be decades before engineering has been developed to meet the practical requirements for utilization of hydrogen per se as a commercially significant fuel. The desirability of utilizing hydrogen as a fuel is based on three factors. First, hydrogen can be produced in abundance from abundant and inexpensive raw materials. Second, as a source of energy, hydrogen provides 61,000 BTU/pound upon combustion and third, the product of hydrogen combustion is water, which poses no pollution threat to the ecology.

To enhance the combustion of a number of conventional fuels and fuels of poor combustibility, it has been previously suggested to add gaseous hydrogen to the combustion mixture. The addition of hydrogen to combustion mixtures can provide additional thermal energy release, lower ignition temperatures, advance flame speeds, reduce the undesirable emissions of nitrogen oxides and carbon monoxide and generally effect a more efficient combustion. However, the previously proposed methods of adding hydrogen to combustion mixtures have consisted of adding gaseous hydrogen to the volatilized fuel at the time of ignition or just prior thereto; see for example U.S. Pat. No. Re. 28,547. The systems proposed heretofore for injecting gaseous hydrogen into a combustion mixture have been complex, costly and of questionable reliability. In general, the prior systems have required such things as a separate hydrogen injection system, including dual fuel supply lines; provision for generation and/or storage of hydrogen gas and new carburetion control systems and like complicated apparatus. As of this time, no commercial hydrogen gas utilizing system has been available because of the technical problems involved in meeting these requirements.

By the method of my invention, hydrogen is made available to the combustion mixture by dissolving a hydrogen carrier in the base fuel to obtain novel fuel compositions. The carrier releases hydrogen for combustion at the time of ignition and thus obviates the need for a separate hydrogen gas injection system, dual fuel supply system, special carburetion devices, fuel mixing controls and hydrogen gas releasing or generating and storage equipment. The fuel compositions of my invention are also advantageous in that the hydrogen carrier employed is a chemical compound which has chemically bound hydrogen. The release of hydrogen from the carrier occurs when the chemical bond is broken with a consequent release of energy. This energy release serves as an "energy kick" to assist ignition and boost combustion of the base fuel and the additive.

It was previously appreciated that ammonia in admixture with air forms an explosive fuel mixture which can operate internal combustion engines. However, ammonia has been considered inferior to hydrocarbons as a fuel because it has a relatively high ignition temperature in admixture with air, i.e.; on the order of about 780° C. Furthermore, the explosive range of ammonia and air mixture is quite narrow, i.e.; within a range of about 16 to 25% by weight of anhydrous ammonia in admixture with air. This requires sensitive carburetors. Also the higher temperatures require different alloys and designs for the engine.

Illustrative of prior art attempts to obtain a satisfactory fuel composition based on ammonia in U.S. Pat. No. 2,559,605 which discloses the addition of an auxiliary gas to prime the explosion of a mixture of air and ammonia. Representative of the auxiliary gases disclosed are hydrocarbon gases, carbon monoxide, methanol vapors, methylether, ethylether, methylamine, ethylamine or a mixture of such gases. In U.S. Pat. No. 2,393,594 an attempt was made to upgrade ammonia as a fuel for use in internal combustion engines by dissolving ammonium nitrate (as an oxidizer) in liquid ammonia. The latter patent also discloses fuel mixtures of ammonia and low molecular weight alcohols with ammonium nitrate dissolved therein. Another approach is represented by U.S. Pat. No. 2,140,254 which discloses a device employing fuel mixtures for internal combustion engines comprising mixtures of ammonia with hydrogen gas and nitrogen gas. Other approaches to the use of ammonia as a fuel have included its admixture with hydrocarbon fuels for use in internal combustion engines (see for example U.S. Pat. Nos. 1,589,885; 1,671,158; and 3,150,645). Compositions of ammonia and at least 30% by weight of lithium borohydride are disclosed in U.S. Pat. No. 3,108,431 as rocket fuels, i.e.; fuels possessing hypergolicity.

Although it was previously known that certain borohydrides formed mono, di, tri and tetra-ammoniates (U.S. Pat. No. 3,108,431) and that certain boron compounds were advantageously used in admixture with liquid hydrocarbon fuels (see for example U.S. Pat. Nos. 3,738,819; 3,403,014; 3,215,740) it was not heretofore appreciated that minor proportions of these compounds could be employed to prime and enhance the combustion of ammonia-air mixtures.

In general, all of the prior art compositions and methods of employing ammonia as a fuel have not been entirely satisfactory for a number of reasons such as, for example, the difficulty in employing a relatively pure ammonia and obtaining the necessary high initial heat flash to bring about an auto-ignition. No commercial application ever resulted from such attempts.

The improvements of petroleum distillates such as gasoline as a fuel, by the addition of from 4 to 10% by weight of hydrogen gas to the vapors of gasoline has been suggested; see, for example, Chemical and Engineering News, Apr. 14, 1975, page 19. The benefits suggested include a reduction of nitrogen oxide emissions and carbon monoxide emissions due to the lower ignition temperatures associated with the mixtures. However, as discussed above, the difficulty of using hydrogen gas heretofore for its fuel potential, particularly as a motor fuel resides in the engineering problems of storing, transporting and adapting it to the automobile engine. These difficulties are overcome by the method of my invention. The addition of ammonia to improve hydrocarbon fuels is disclosed in U.S. Pat. Nos. 1,589,885 and 1,671,158.

Quaternary ammonium borohydrides are disclosed in U.S. Pat. No. 3,403,014 as useful when added to high volatility gasoline (Reid vapor pressure above 9) in proportions of from 0.001 to 0.1% by weight of the gasoline, as a cold weather anti-stalling additive.

Current interest in substitutes for petroleum based fuels has included the lower molecular weight, volatile alcohols such as methanol, ethanol and t-butanol which can be synthesized without resort to petroleum starting materials. Methanol has been thoroughly studied as a fuel (see for example Reed et al., Science 182, No. 4119, page 1299). The advantage of using methanol as a base fuel is related to its high octane rating, the lower combustion temperatures with consequent lower exhaust temperatures, lower emissions of nitrogen oxides and improved combustion of mixtures of gasoline with up to 15% by weight of methanol.

There are, however, disadvantages associated with the use of methanol, alone or in admixture with gasoline as a fuel. For example, methanol may require heating to volatilize. In addition, methanol has a low flame speed, corrodes engine parts (through aldehyde and acid formation) and lowers mileage per gallon (by a factor of 0.5) because of its lower energy value (in comparison to gasoline). By the method of my invention, methanol as a fuel may be upgraded in that combustion efficiency is improved, flame speed is increased, corrosion inhibited and the miles per gallon ratio improved.

SUMMARY OF THE INVENTION

The invention comprises a method of improving the combustion of a base fuel selected from the group consisting of ammonia, petroleum distillates, alcohols having 1 to 16 carbon atoms, inclusive and a molecular weight of from 17 to 275 and organic amines having a molecular weight of from about 17 to about 110, which comprises; mixing in said base fuel from 0.5 to 15% by weight of a hydrogen carrier; and combusting the resulting mixture; said hydrogen carrier being a compound of hydrogen and at least one element selected from the group consisting of lithium, sodium, potassium, magnesium, boron, aluminum and nitrogen; said compound having a molecular weight of from 8 to about 125, a heat of formation of from about 10 kcal. to about 100 kcal. per mole and compatibility with the base fuel selected, at ambient temperatures.

The term "ambient temperatures" as used herein means a temperature within the range of about minus 20° F. to about 250° F.

The invention also comprises novel fuel compositions which comprise from 0.5% to 15% by weight of a compound of hydrogen and one or more elements selected from the group consisting of lithium, sodium, potassium, aluminum, magnesium, boron and nitrogen, said compound having a molecular weight of from 8 to 125 and a heat of formation of from about 10 kcal. to about 100 kcal. per mole; mixed in a base fuel selected from the group consisting of ammonia, petroleum distillates, alcohols having from 1 to 16 carbon atoms, inclusive and a molecular weight of from 32 to about 275 and organic amines having a molecular weight of from 31 to about 110; provided that the compound selected is non-reactive with the base fuel it is mixed in at ambient temperatures, does not lower the shelf life of the base fuel, does not deteriorate below the ignition temperature of said fuel composition to release energy and at the point of ignition, releases energy and hydrogen, said fuel composition being non-hypergolic.

The term "non-hypergolic" is used herein in its usual sense as meaning the composition is not ordinarily spontaneously combustible, when in contact with an oxidizer.

The compositions of the invention are particularly useful fuels for internal combustion engines, turbine engines, turbine jet engines and for combustion in conventional space heating apparatus.

DETAILED DESCRIPTION OF THE INVENTION

The method of the invention is carried out by first mixing from 0.5 to 15% by weight of the hydrogen carrier in the selected liquid base fuel. Mixing may be effected by bringing the components of the novel composition together at ambient temperatures and admixing with the aid of conventional and appropriate mixing equipment. The novel fuel compositions so obtained are then ignited in conventional furnaces, internal combustion engines, turbine engines and like energy utilizing apparatus appropriate for the desired combustion and use of the fuel compositions.

The base fuels employed in the method of the invention are well known materials characterized in part as liquids which are largely volatile at ambient temperatures. More particularly, ammonia may be employed in its liquid form as a base fuel or in combination with the other fuels such as alcohols, amines and/or hydrocarbons in the method of the invention. Similarly, saturated and unsaturated alcohols having from 1 to 16 carbon atoms, inclusive, may be used as base fuels. Such alcohols are well known, and may be illustrated by the aliphatic alcohols such as methanol, ethanol, n-propanol, isopropanol, n-butanol, t-butanol, n-pentanol, isopentanol, hexanol, heptanol, octanol, decanol, hexadecanol and the like. The cycloaliphatic alcohols such as cyclohexanol may also be employed. Unsaturated aliphatic alcohols such as 1-buten-4-ol, and the like are also representative of useful base fuels employed in the method of the invention.

It is realized that many chemical compounds falling within the classifications stated are useful but only a limited number possesses economical virtue.

Petroleum distillate base fuels are defined as the products of fractional distillation of petroleum and include for example petroleum ether (the pentane-hexane-heptane low boiling mixture); gasoline (the heptane to dodecane mixture); kerosene (the decane to hexadecane mixture) (to 16 carbons) benzene, naphtha, toluene, n-hexane and like distillates (the kerosenes and additives most useful for jet engines).

Organic amines which may be employed as base fuels in the method of the invention are represented by methylamine, dimethylamine, diethylamine, triethylamine, aniline, cyclohexylamine, and the like.

Preferred as the base fuel according to the invention are ammonia, certain lower aliphatic amines (see above) and aliphatic alcohols, particularly methanol, ethanol and t-butyl alcohol, by themselves, in mixtures of these with or without hydrocarbon admixtures.

The hydrogen carriers employed as components of the compositions of the invention may be characterized as organic and inorganic compounds having a high energy content, i.e.; a positive heat of formation of from 10 kcal. to about 100 kcal. per mole and are combustible. In addition, the hydrogen carriers employed are soluble or miscible (emulsifiable) in the base fuels with which they are combined, at ambient temperatures. Those skilled in the art will appreciate that the hydrogen carriers selected for compounding with a particular base fuel must be inert in respect to chemical reaction therewith under ordinary and ambient temperature conditions. By inert, we mean that the hydrogen carriers are stable and non-reactive with the base fuel under ordinary storage conditions and do not adversely affect the shelf-life of the base fuel. The hydrogen carrier must release its energy and decompose at or just under the ignition temperature of the compositions of the invention so that energy and hydrogen are released for combustion at the time of ignition. The hydrogen carrier must be carefully selected to meet the conditions outlined above, for each particular base fuel to be compounded therewith.

AMMONIA AS BASE FUEL

The preferred ammonia based fuel compositions of the invention may be prepared by admixture of liquid ammonia with a hydrogen carrier compound. Preferred hydrogen carriers to be added to ammonia fuel are those selected from a boron hydride, a borohydride, a hydrazine including a lower aliphatic or aromatic, by themselves or by combination with each other in the proportions set forth above. Admixture of the fuel composition components is conveniently carried out at ambient temperatures employing conventional equipment. Although the ammonia component may be admixed in its gaseous form, the admixture is preferably carried out with ammonia in its liquid state under refrigeration and/or super-atmospheric pressure. Preferably anhydrous ammonia is used as the base fuel. Also, ammonia dissolved in an organic solvent which per se is a combustible material.

Any boron or borohydride compound may be employed as a hydrogen carrier component of the ammonia base fuel composition of the invention, which is characterized by its ability to release energy and be oxidized readily. Representative of boron and borohydrides employed in preparing the ammonia base fuel compositions of the invention are organic and inorganic boron hydrides such as, for example, diborane, pentaborane, borazine, borazol and inorganic borohydrides: metal borohydrides such as lithium borohydride, lithium cyanoborohydride, aluminum borohyride, and the like; adducts of metal borohydrides and organic polynitrogen compounds such as those disclosed in U.S. Pat. No. 3,342,814 and having the formula:

$$L.[M(BH_4)_x]_n \qquad \text{(II)}$$

wherein L is an organic nitrogen compound composed solely of carbon hydrogen and nitrogen atoms, said organic nitrogen compound containing at least 1 nitrogen atom coordinately bonded to M where M represents aluminum; wherein x is the valence of M and wherein n is an integer having a minimum value of 1 and a maximum value no greater than the number of nitrogen atoms contained in the organic nitrogen compound L which function as Lewis bases; with the proviso that when M is aluminum then L cannot be $R_2NZ$ wherein each R is a monovalent saturated hydrocarbon radical, and wherein Z is hydrogen or a monovalent saturated hydrocarbon radical. Organic borohydrides such as sodium triethylborohydride, sodium trimethoxyborohydride, cetyltrimethylammoniumborohydride, tetraethylammoniumborohydride, tricaprylmethylammoniumborohydride, triphenylphosphineborane and the like; hydrazonium borohydrides such as those disclosed in U.S. Pat. No. 3,215,740 and having the general formula:

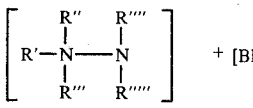

$$\left[ R'-\overset{\overset{R''}{|}}{N}-\overset{\overset{R''''}{|}}{N}\begin{matrix} R''' \\ | \\ \\ | \end{matrix} R''''' \right] + [BH_4]^- \qquad \text{(III)}$$

wherein R′, R″, and R‴ are alkyl and R⁗ and R′⁗ are the same or different and are selected from the class consisting of hydrogen and aklyl; and like hydrazonium borohydrides.

Hydrazine compounds employed as hydrogen carriers in the preparation of ammonia base fuel compositions are represented by hydrazine, monoalkyl substituted hydrazines such as monomethylhydrazine and the like; unsymmetrical dialkylhydrazines such as unsymmetrical dimethylhydrazine and the like; symmetrical dialkylhydrazines such as for example symmetrical diethylhydrazine, trialkyl substituted hydrazines such as for example trimethylhydrazine and tetraalkyl substituted hydrazines such as for exmple, tetramethylhydrazine, aromatic hydrazines such as phenylhydrazine and the like.

Representative of other hydrogen carriers which may be compounded with ammonia to provide compositions of the invention are sodium amide, potassium amide, boronhydride, lithium borohydride, sodium borohydride and the like.

Preferred hydrogen carriers in the method of the invention and for ammonia based fuel compositions are the compounds wherein the element compounded with hydrogen is one or more of lithium, sodium, potassium, boron or nitrogen. Exemplary of such hydrogen carriers are:

(a) hydroxylamine;
(b) iminoalcohols, like N-(2-hydroxy-ethyl)-ethylene imine.
(c) hydrazines including alkyl substituted hydrazines as represented by hydrazine, hydrazine hydrate, methylhydrazine, symmetrical dimethylhydrazine, unsymmetrical dimethylhydrazine, phenylhydrazine, butylhydrazine, hexylhydrazine and the like;
(d) boranes such as diborane, pentaborane, borazine and the like;
(e) borohydrides such as lithium borohydride, magnesium borohydride and the like;
(f) borane-amine complexes such as borane-tert-butylamine, borane.dimethylamine, borane.triethylamine, borane.trimethylamine, borane.pyridine, ammonia.-hydrazine.decaborane adduct (U.S. Pat. No. 3,291,662), hydrazine.diborane U.S. Pat. No. 3,323,878), hydrazine.tetraborane, hydrazine.pentaborane, trihydrazine.decaborane, dimonomethylhydrazine.pentaborane, trimonomethylhydrazine.pentaborane, methylhydrazine.decaborane, dimethylhydrazine.decaborane, hydrazine-bis-borane, hydrazino-bis-borane, dimethylhydrazine-bis-borane (U.S. Pat. No. 3,450,638), diammoniate.diborane (U.S. Pat. No. 3,576,609) and the like;

(g) hydrazinoalkanols such as 2-hydrazinoethanol and the like; and (h) borohydride-ammonia adducts such as lithium borohydride.monoammoniate (U.S. Pat. No. 3,108,431) and the like.

PETROLEUM DISTILLATES AS A BASE FUEL

In general, the petroleum distillate base fuels may be improved by the method of the invention by admixing one or more of the same hydrogen carriers described above in relation to ammonia as a base fuel. Preferred as the hydrogen carriers in admixture with petroleum distillates are hydrazines, especially alkyl hydrazines such as unsymmetrical dimethylhydrazine, boron-hydrogen adducts like [amine] $BH_3$ or higher homologues. One of the significant improvements resulting from the presence of the additives described herein relates to significant reduction of undesirable emission components. Also combustion efficiency is increased.

ALCOHOLS AS A BASE FUEL

Those skilled in the art will appreciate that the reactivity of alcohols with labile hydrogen limits the additive hydrogen carrier components which may be compounded with them. In general, the carrier compounds described above in relation to the improvement of ammonia as a base fuel may be used, provided they are non-reactive with the alcohol. Representative of preferred hydrogen carriers employed as components of the novel compositions of the invention employing alcohols as a base fuel are the hydrazines described in group (c) above and the borane-amine complexes described in (f) above, provided they are non-reactive with the alcohol and with water.

ORGANIC AMINES AS THE BASE FUEL

A broad range of hydrogen carrier compounds may be admixed with organic amine base fuels to improve their combustion. In general, all of the aforementioned carrier compounds may be used. Preferred carriers for admixture with organic amine base fuels are the boronhydrides [group (e) above], the hydrazines [group (c) above] and the borane.amine complexes [group (f) above].

The base fuels described above may also be used in admixture with one another. For example, ammonia may be dissolved in the amine fuel and serve as a solvent for the hydrogen carrier which in this case advantageously may be represented by unsymmetrical dimethyl hydrazine or one of the amine-borane adducts. As a further example, kerosene and an amine fuel such as triethyl amine may be admixed with an amine-$BH_3$ adduct as the hydrogen carrier such as, for example, an amineborohydride adduct (amineborane) as a hydrogen carrier. A preferred hydrogen carrier for use in such a mixture of base fuels is the adduct of equimolar proportions of ammonia and one-half $B_2H_6$: ($NH_3.BH_3$) or a methylamine or ethylamine-$BH_3$ adduct; i.e.; $CH_3NH_2.BH_3$; $(C_2H_5)NH_2.BH_3$; $(C_2H_5)_2NH.BH_3$; $(C_2H_5)_3N.BH_3$ or corresponding hydrazine adducts like $(CH)_2NNH_2.BH_3$.

In a preferred embodiment of the invention, the hydrogen carrier is a hydrate such as, for example, hydrazine hydrate ($N_2H_5OH$) or a hydrazino alcohol. In this manner, oxygen as well as steam are contributed to the ignition and combustion process.

In another preferred embodiment of the invention, the hydrogen carrier is an amino-alcohol, like N-hydroxyethyl-ethylene imine. Such novel compositions have the further advantage of improving combustion efficiency and lowering the emission of noxious by-products.

The base fuels described above may also be used in admixture with one another. For example, ammonia may be dissolved in methanol and both may serve as solvent for the hydrogen carrier which in this case advantageously may be represented by unsymmetrical dimethyl hydrazine, or a stable aminoborane ("stable" meaning unreactive or very slowly reactive with the alcohol base fuel in the particular mixture of alcohol and ammonia employed). As a further example, kerosene and an amine fuel such as triethylamine, hydrogen carriers such as, for example, an aminoborane adduct as a hydrogen carrier. A preferred hydrogen carrier for use in such a mixture of base fuels is the adduct of equimolar proportions of ammonia and boronhydride.

In addition to the hydrogen carrier, the compositions of the invention may also contain other additives having specific desired functions. For example, combustion deposit modifiers such as clays may be added to the compositions of the invention. Anti-oxidants, metal deactivators, corrosion inhibitors, anti-icing agents, detergents, dyes, lubricants and like conventional fuel additives may be added to the fuel compositions of the invention in conventional proportions to effect their particular purposes upon combustion of the composition of the invention.

The compositions of the invention may be combusted in conventional combustion equipment or the equipment may be modified to meet the special properties of an individual composition to obtain maximum efficiency, i.e.; compression ratios, cycle timing, air mixtures, pump means for controlling the flow of fuel, combustion timing mchanisms, and like control devices may be modified to meet the specific combustion characteristics of the fuels provided by the method of this invention. Those skilled in the art will appreciate how to effect the desired and advantageous modifications when required for maximum fuel efficiency.

The ammonia and alcohol based fuels are particularly advantageous fuels for turbine and internal combustion engines. For example, the alcohol and ammonia based fuel compositions of the invention may be employed in internal combustion engines using apparatus and techniques previously known. Illustratively, the compositions of the invention may be stored and delivered to carburetor of the internal combustion engine described in U.S. Pat. No. 2,559,605. The liquid mixtures uon reaching the carburetor are volatilized and admixed with air before being drawn into the combustion chambers of the engine. Although it is preferred that the mixture of ammonia based fuel with air be in such proportions as to provide from about 15 to about 30% by weight of ammonia, other proportions may be employed outside of this preferred range. Similarly, a wide range of compressions are usable in combusting the ammonia based compositions of the invention when mixed with air.

When the base fuel is an alcohol such as methanol, the compositions of the invention are admixed with air for combustion (after volatilization). The compressions usable in combusting the methanol based compositions of the invention are within the normal and known compressions for methanol used per se. (Methanol responds well to highest compression ratios).

The petroleum distillates and organic amines may similarly be employed as fuels in conventional and known equipment for combusting such fuels without major modifications.

The following examples describe the manner and process of making and using the invention and set forth the best mode contemplated by the inventor of carrying out the invention but are not to be construed as limiting.

EXAMPLE 1

A suitable pressure reaction vessel is charged with 100 lbs. of liquid ammonia. To this charge there is added with stirring 1 lb. of lithium borohydride. The resulting mixture is stirred for about 15 minutes and then transferred to a pressure container where the liquid mixture is maintained. The resulting fuel is useful to power turbine engines. Similarly, repeating the above procedure but replacing the lithium borohydride as employed therein with an equal proportion of any other hydrogen carrier compound suitable for compounding with ammonia as described previously, a composition of the invention is obtained.

EXAMPLE 2

A suitable reaction vessel is charged with 100 lbs. of methanol. To this charge there is added with mixing 3 lbs. of unsymmetrical dimethylhydrazine. The resulting mixture is a fuel which may be used in internal combustion engines. Similarly, repeating the above procedure but replacing the UDMH as used therein with any other hydrogen carrier previously described as suitable for admixture with an alcohol, a composition of the invention is obtained.

EXAMPLE 3

A suitable vessel is charged with 100 lbs. of kerosene. To this charge there is added with stirring 5 lbs. of hydrazine base. The resulting fuel may be used in a kerosene burning heating plant. Similarly, following the above procedure but mixing in place of the hydrazine base any other hydrogen carrier described above as suitable for mixture with a petroleum distillate, compositions of the invention are obtained.

EXAMPLE 4

A suitable vessel is charged with 100 lbs. of dimethylamine. To the charge there is added with mixing 4 lbs. If unsymmetrical dimethylhydrazine (UDMH). The resulting fuel may be used to power heating plants. Similarly, following the above procedure but replacing the UDMH as used therein with any other hydrogen carrier described above as useful for mixture with an amine fuel, a composition of the invention is obtained.

EXAMPLE 5

The pressure container prepared in Example 1 above and containing 99% by weight ammonia with 1% by weight of lithium borohydride is attached to a pressure reducing valve previously connected to an air mixing burner. The valve is opened to permit the fuel composition to enter the burner head and to be admixed with air in the ratio of about 75 to 25 parts of air to the fuel composition. The air fuel composition is ignited and found to burn evenly with a bright yellow flame.

EXAMPLE 6

Following the general procedures outlined in Examples 1–4, inclusive, additional fuel compositions of the invention may be prepared as follows:

| | PERCENT ADDITIONS TO EACH OF THESE FUELS: | | | | | | |
|---|---|---|---|---|---|---|---|
| Additive Hydrogen Carriers | Lower Alcohols | Ammonia or Organic Amines | Hydrocarbons (Petroleum Distillates) | MeOH Plus Water 1% | MeOH 20% Gasoline +0.5% $H_2O$ | MeOH Sat'd with $NH_3$; Amines | Hydrocarbons Sat'd with $NH_3$ Amines |
| Alkyl Hydrazines | 1–5–10–15 | 1–5–10–15 | 2–5–7.5–15 | 3–7.5–15 | 2–5–7.5 | 2–5–10 | 2–5–10 |
| Amine + Hydrazines | 3–7.5–15 | 3–7.5–15 | 3–7.5–15 | 2–7.5–10 | 2–5–10 | 5–10 | 3–5–10 |
| Hydrazine Base | -0- | -0- | 1–2–3 | 1–2–3 | 2–5 | 1–2–3 | 1–2–3 |
| Borane - Amine | 2–5–10–15 | 3–7.5–15 | 2–7.5–15 | -0- | -0- | 2–5–7.5 | 2–5–7.5 |
| UDMH - Borane | 2–7.5–15 | 3–7.5–15 | 2–5–10–15 | -0- | -0- | 2–5–10 | 2–5–7.5 |
| UDMH + Amine-Borane | 2–7.5–15 | 3–7.5–15 | 2–7.5–15 | -0- | -0- | 2–7.5–15 | 2–5–10 |
| Ammonia - $BH_3$ Adducts | -0- | 2–7.5–15 | 3–7.5–15 | -0- | -0- | -0- | 3–7.5–15 |
| Ammonia + UDMH | 5–10–15 | -0- | 3–7.5–15 | 3–5–15 | 3–5–10 | 3–5–10 | 3–7.5–15 |

All of the above fuel compositions may be used as energy fuels in conventional engines, turbines and like energy fuel consuming devices.

What is claimed:

1. A method of improving the combustion of a base fuel selected from the group consisting of ammonia, petroleum distillates, alcohols having 1 to 16 carbon atoms, inclusive, and a molecular weight of from 17 to 275 and organic amines having a molecular weight of from about 17 to about 110, which comprises;

mixing in said base fuel from 0.5 to 15% by weight of a hydrogen carrier; and combusting the resulting mixture; said hydrogen carrier being a compound selected from the group consisting of borane-amine complexes, borane-ammonia complexes, and ammonia-$BH_3$ adducts (coordination complexes) of the formula $(NH_3)_x.(BH_3)_y$ where x and y are each integers of from 1–3, said compound having a heat of formation of from about 10 kcal. to about 100 kcal. per mole and compatibility with the base fuel selected, at ambient temperatures.

2. The method of claim 1 wherein said compound is an adduct selected from the group consisting of amine-borohydride adducts and ammonia-borohydride adducts.

3. A composition, which comprises;

from 85 to 99.5 percent by weight of a base fuel selected from the group consisting of ammonia, petroleum distillates, alcohols having 1 to 16 carbon atoms, inclusive and a molecular weight of from 17 to 275, organic amines having a molecular weight of from about 17 to about 110 and mixtures thereof; and from 0.5 to 15 percent by weight of a hydrogen carrier, said hydrogen carrier being a compound selected from the group consisting of borane-amine complexes, borane-ammonia complexes and ammonia-$BH_3$ adducts (coordination complexes) of the formula $(NH_3)_x.(BH_3)_y$ wherein x and y are each integers of from 1 to 3, said compound having a heat of formation of from about 10 kcal. to about 100 kcal. per mole and compatibility with the base fuel selected, at ambient temperatures.

4. A composition of claim 3 wherein the compound selected is an adduct selected from the group consisting of amine-borohydride adducts and ammonia-borohydride adducts.

* * * * *